US006926151B1

(12) United States Patent
Perry et al.

(10) Patent No.: US 6,926,151 B1
(45) Date of Patent: Aug. 9, 2005

(54) TOOL HOLDER AND METHOD OF USE

(76) Inventors: Martha Starr Perry, 10 Ski Haven, Justin, TX (US) 76247; Michael Stuart Perry, 10 Ski Haven, Justin, TX (US) 76247

( * ) Notice: Subject to any disclaimer, the term of this patent is extended or adjusted under 35 U.S.C. 154(b) by 97 days.

(21) Appl. No.: 10/274,334

(22) Filed: Oct. 18, 2002

Related U.S. Application Data

(60) Provisional application No. 60/394,617, filed on Jul. 9, 2002.

(51) Int. Cl.[7] ..... B65D 85/20

(52) U.S. Cl. ..... 206/750; 206/214; 206/349; 206/361; 206/362; 206/363; 206/370; 206/371; 206/372; 206/373; 206/376; 206/752; 383/39; 493/210

(58) Field of Search ..... 150/103, 132, 150/143, 149, 131; 206/1.7–1.9, 45.23, 362, 206/372, 373, 443, 581, 214, 349, 361, 362.1, 206/362.4, 363, 370, 371, 374–379, 747–752, 206/760, 823; 248/174; 383/39; 493/210, 493/214, 223, 227–229, 239

(56) References Cited

U.S. PATENT DOCUMENTS

| | | | | |
|---|---|---|---|---|
| 1,085,950 | A | | 2/1914 | Steinthal |
| 1,094,009 | A | | 4/1914 | Parkhurst |
| 1,128,542 | A | | 2/1915 | Steinthal |
| 1,434,350 | A | | 10/1922 | Collins |
| 2,679,877 | A | | 6/1954 | Leggett |
| 3,749,233 | A | | 7/1973 | McCormick, Jr. |
| 4,101,025 | A | | 7/1978 | Jordan |
| 4,210,244 | A | | 7/1980 | Westrick |
| 4,287,986 | A | * | 9/1981 | Beck ..... 206/765 |
| 4,341,331 | A | * | 7/1982 | McDougall ..... 224/219 |
| 4,478,333 | A | | 10/1984 | Dalbo et al. |
| 4,651,872 | A | * | 3/1987 | Joyce ..... 206/760 |
| 4,715,499 | A | | 12/1987 | Franklin |
| 4,738,547 | A | | 4/1988 | Brown |
| 4,901,899 | A | | 2/1990 | Barrett |
| 4,917,505 | A | * | 4/1990 | Bullard et al. ..... 383/4 |
| 4,949,843 | A | | 8/1990 | Stokes |
| 5,002,401 | A | | 3/1991 | Blackman |
| 5,020,673 | A | | 6/1991 | Adams |
| 5,139,143 | A | | 8/1992 | Pond |
| 5,314,102 | A | * | 5/1994 | Roy ..... 224/586 |
| 5,427,239 | A | | 6/1995 | Hunt |
| D373,900 | S | * | 9/1996 | Montgomery, Sr. ..... D3/226 |
| 5,671,481 | A | * | 9/1997 | Giard ..... 2/170 |
| 5,755,366 | A | * | 5/1998 | Mazzo ..... 224/222 |

(Continued)

*Primary Examiner*—Jim Foster
(74) *Attorney, Agent, or Firm*—Schultz & Associates, P.C.

(57) ABSTRACT

The present invention is directed to a tool holder convertible between storage and display configurations and a method of manufacture therefor. In one embodiment, the tool holder includes a flexible wrapper including first and second parallel major and minor edges and a fold line located between the first and second major edges. The first minor edge includes a first notch proximate a corner thereof. The tool holder also includes a first fastener including first and second portions located proximate the first and second minor edges, respectively, that is alignable in opposition to allow a coupling of the first and second minor edges.

32 Claims, 10 Drawing Sheets

U.S. PATENT DOCUMENTS 5,769,213 A * 6/1998 Chatterton ..... 206/38
5,984,092 A 11/1999 Heard-Willmon
6,109,442 A 8/2000 Roegner
6,244,485 B1 6/2001 Holland et al.
6,244,486 B1 6/2001 Holland et al.
6,398,027 B1 6/2002 Ryu

* cited by examiner

TOOL HOLDER AND METHOD OF USE

CROSS-REFERENCE TO PROVISIONAL APPLICATION

This Application claims priority from a provisional application entitled "Convertible Pouch," to Perry, et al, Ser. No. 60/394,617, filed on Jul. 9, 2002, which is commonly owned with the present invention and incorporated herein by reference as if reproduced herein in its entirety.

TECHNICAL FIELD OF THE INVENTION

The present invention is directed in general, to a tool holder configuration and, more specifically, to a tool holder convertible between storage and display configurations and a method of manufacture therefor.

BACKGROUND OF THE INVENTION

Technicians are constantly confronted with the need to store and protect the tools of their trade. To protect their investment from damage and loss while simultaneously trying to keep them clean and readily available, various types of tool kits and tool holders have been developed. Traditionally, tools have been kept in a conventional tool box. A conventional tool box, however, does not prevent abrasion between the tools and the box interior or other tools in the box and, as such, can scratch or break the tools and does not contribute toward keeping the tools clean and in good condition. A conventional tool box for delicate tools (e.g., brushes) is undesirable.

To improve protection for the tools and to keep them in an organized fashion, various roll-up tool bags have also been designed. A conventional, roll-up tool bag includes a plurality of pockets with each pocket designed to receive an individual tool. The roll-up tool bag is typically made of a soft, flexible material that enables the bag containing the tools to be rolled up for convenient, compact storage or transportation when the tools are not in use. Securing the tool bag in its rolled-up configuration is usually accomplished with circumferential straps or ties, thereby allowing for varying thickness of the bag because of a varying number of tools therein. The thickness of the rolled-up tool bag is dictated by the tools contained therein and the length/number of pockets of the tool bag.

Although roll-up tool bags help to prevent direct contact between the tools and aid in keeping the tools clean, a major drawback to conventional tool bags has been encountered. Tool accessibility is generally accomplished with a conventional, roll-up tool bag unrolled and laid flat upon a horizontal surface, thereby occupying a significant amount of work space. Alternatively, the tool bag may be attached to some vertical surface with hanging hooks, magnets or the like if a suitable surface is available. However, in some trades, it would be desirable to have the tools at least partially displayed in a vertical fashion to facilitate selection of a desired tool. One such trade is cosmetology, wherein a cosmetologist could benefit by more quickly selecting a desired applicator, typically a brush, if all of the available applicators were vertically displayed in a holder that takes up less work surface. Additionally, the cosmetologist is usually confronted with limited work space upon which to place their tools.

Accordingly, what is needed in the art is a flexible, roll-up tool holder that protects the tools when closed, and enables conversion to a display configuration that takes up less work space while conveniently presenting the tools for easy access.

SUMMARY OF THE INVENTION

To address the above-discussed deficiencies of the prior art, the present invention provides a tool holder including a flexible wrapper and a first fastener. In one embodiment, the flexible wrapper includes first and second parallel major and minor edges and a fold line located between the first and second major edges. The first minor edge includes a first notch proximate a corner thereof. The first fastener includes first and second portions located proximate the first and second minor edges, respectively, that are alignable in opposition to allow a coupling of the first and second minor edges.

The tool holder of the present invention is convertible between a storage and display configuration. The tool holder, therefore, provides dual functionality in a compact and conveniently deployed package. The tool holder is employable in many applications including the field of cosmetology wherein flexibility in tool storage and presentation is very beneficial.

In another aspect, the present invention provides a method of manufacturing a tool holder. The method includes providing a flexible wrapper including first and second parallel major and minor edges, and forming a fold line between the first and second major edges. The method also includes forming a first notch proximate a corner of the first minor edge. The method still further includes locating a first portion of a first fastener proximate the first minor edge, and locating a second portion of the first fastener proximate the second minor edge.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
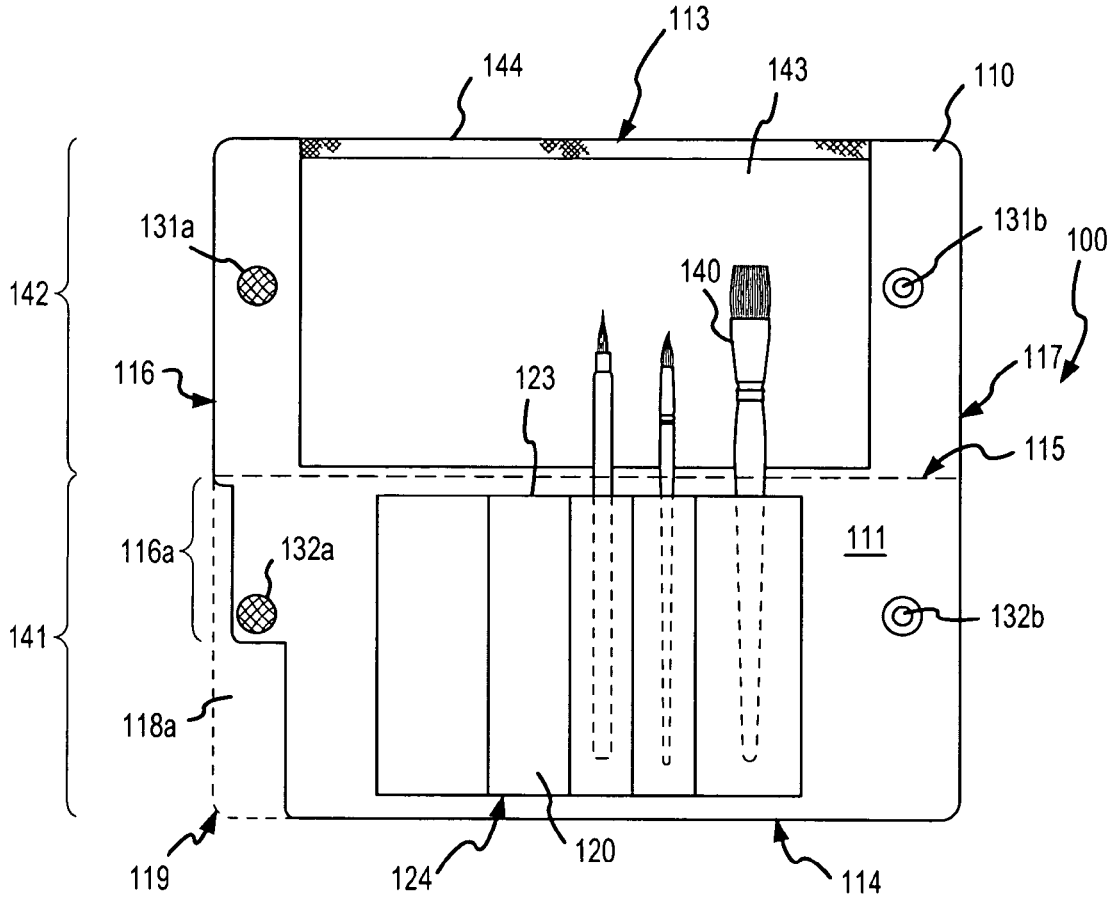
FIG. 1 illustrates a plan view of one embodiment of a tool holder constructed according to the principles of the present invention.

Referring initially to FIG. 1, illustrated is a plan view of one embodiment of a tool holder 100 constructed according to the principles of the present invention. The tool holder 100 includes a flexible wrapper 110, a pocket or plurality of pockets (one of which is designated 120), and first and second fasteners. While two fasteners are illustrated, it should be clear to those skilled in the art that only a single fastener is necessary to comply with the principles of the present invention. The flexible wrapper 110 has an inner face 111 and an outer face (see FIG. 2). The tool holder 100 is shown in FIG. 1 as it would appear laid open upon a horizontal surface.

The flexible wrapper 110 is constructed of a sheet-like material, e.g., leather, vinyl, etc., and is preferably substantially rectangular in shape (although other shapes are well within the broad scope of the present invention). The flexible wrapper 110 has first and second parallel major edges 113, 114 (synonymously referred to as first and second major edges), first and second parallel minor edges 116, 117 (synonymously referred to as first and second minor edges), and a fold line (e.g., a centerline) 115 between the first and second major edges 113, 114. While the fold line 115 is illustrated and hereinafter described as a centerline between the first and second major edges 113, 114, those skilled in the art understand that it is not necessary to locate the fold line 115 equidistant between the first and second major edges 113, 114. It should also be understood that for the purposes of this discussion that the terms fold line and centerline may be used interchangeably. The first minor edge 116 has a first notch 118*a* therein proximate a corner 119 thereof. The first minor edge 116 also has an indention 116*a* formed therein from about the first notch 118*a* to about the fold line 115. For the purpose of this discussion, an indention is a portion of an edge that has been cut away to form an indented edge.

The first and second fasteners include first portions 131*a*, 132*a*, and second portions 131*b*, 132*b*, respectively. The first portions 131*a*, 132*a* of the first and second fasteners are spaced apart and coupled to the flexible wrapper 110 proximate the first minor edge 116. The second portions 131*b*, 132*b* of the first and second fasteners are spaced apart and coupled to the flexible wrapper 110 proximate the second minor edge 117. In a preferred embodiment, the first portions 131*a*, 132*a* are male (stud) portions of a conventional snap fastener wherein the stud portion extends from the outer face (see FIG. 2). The back side of the first portions 131*a*, 132*a* are shown in FIG. 1. Similarly, the second portions 131*b*, 132*b* include female (receiving) portions of the snap fasteners with the receiving portion accessible on the inner face 111 of the flexible wrapper 110.

In an alternative embodiment, the first portions 131*a*, 132*a* may be hook portions of a Velcro® fastener and the second portions 131*b*, 132*b*, 133*b* may be pile portions of the Velcro® fastener. Of course, the hook and pile portions may be interchanged while remaining within the scope of the present invention. Similarly, other types of fasteners, e.g., magnetic, clasps, buttons, etc. may also by used. Those skilled in the art are familiar with the conventional methods used to couple or mount such fasteners to the flexible wrapper 110'. When the flexible wrapper 110 is rolled up in a storage configuration, the first portions 131*a*, 132*a* and second portions 131*b*, 132*b* are configured to couple the first and second minor edges 116, 117 together, wherein the second minor edge 117 overlaps the first minor edge 116, thereby hiding the indention 116*a* and the first notch 118*a*.

The pockets 120 are affixed to the inner face 111 by sewing or with a suitable adhesive. In a preferred embodiment, the pockets 120 may include a flexible, sheet-like material compatible with the sheet-like material of the flexible wrapper 110. Of course, other materials including a flexible mesh or transparent flexible material may also be used. Even a flexible, stretchable material may be used. The pockets 120 are affixed to the inner face 111 of the flexible wrapper 110 by conventional means such as sewing, adhesive, etc. Those skilled in the art are familiar with methods of affixing one piece of flexible material to another piece of flexible material, whether they are similar or dissimilar.

The number and size of the pockets 120 is dictated by the type and number of tools desired to be stored or displayed. The pockets 120 have open ends (one of which is designated 123) aligned proximate the fold line 115 and closed ends (one of which is designated 124) aligned proximate the second major edge 114. For illustrative purposes, a variety of tools (one of which is designated 140) are shown in conjunction with the tool holder 100. The open ends 123 of the pockets 120 are configured to each receive at least a portion of each of the tools 140. In a preferred embodiment, the pockets 120 may number five in order to form a convenient size for the tool holder 100 when rolled for storage or formed as a display. However, those skilled in the art will realize that the number of pockets 120 may vary above or below five as required.

The tools 140 may be virtually any tool, e.g., a screwdriver, a nutdriver, a wrench, a brush, a pliers, a scraper, a knife, a pen, a pencil, a scalpel, etc. Of course, there may be more than one of a particular type of tool, e.g., a variety of screwdrivers, etc. In one embodiment, the tools 140 are a variety of cosmetic brushes or artist's brushes. In a preferred embodiment, the tool holder 100 is a cosmetologist's tool holder holding tools such as a brush, lipstick, eyeliner, a mascara pencil, or a spatula. Of course, the exact tools will be dictated by the needs of the user. In another embodiment, the tool holder 100 is an artist's tool holder holding tools such as brushes, drawing pencils, charcoal sticks, etc. Those skilled in the art will recognize that both cosmetologists and artists use a variety of brushes and other tools to accomplish their respective arts.

The fold line 115 of the tool holder 100 defines a first section 141 and a second section 142 of the flexible wrapper 110. In the illustrated embodiment, the first section 141 accommodates the pockets 120 affixed to the inner face 111. The second section 142 accommodates a purse 143 affixed to the inner face 111 of the second section 142. The purse 143 has a closure 144 along at least a portion of the first major edge 113. The purse 143 may be used to hold smaller objects or tools that are not suitable for storage in any of the pockets 120. The closure 144 may be a zipper, plastic zip seal, matching Velcro® portions or similar closures.

Figure 2:
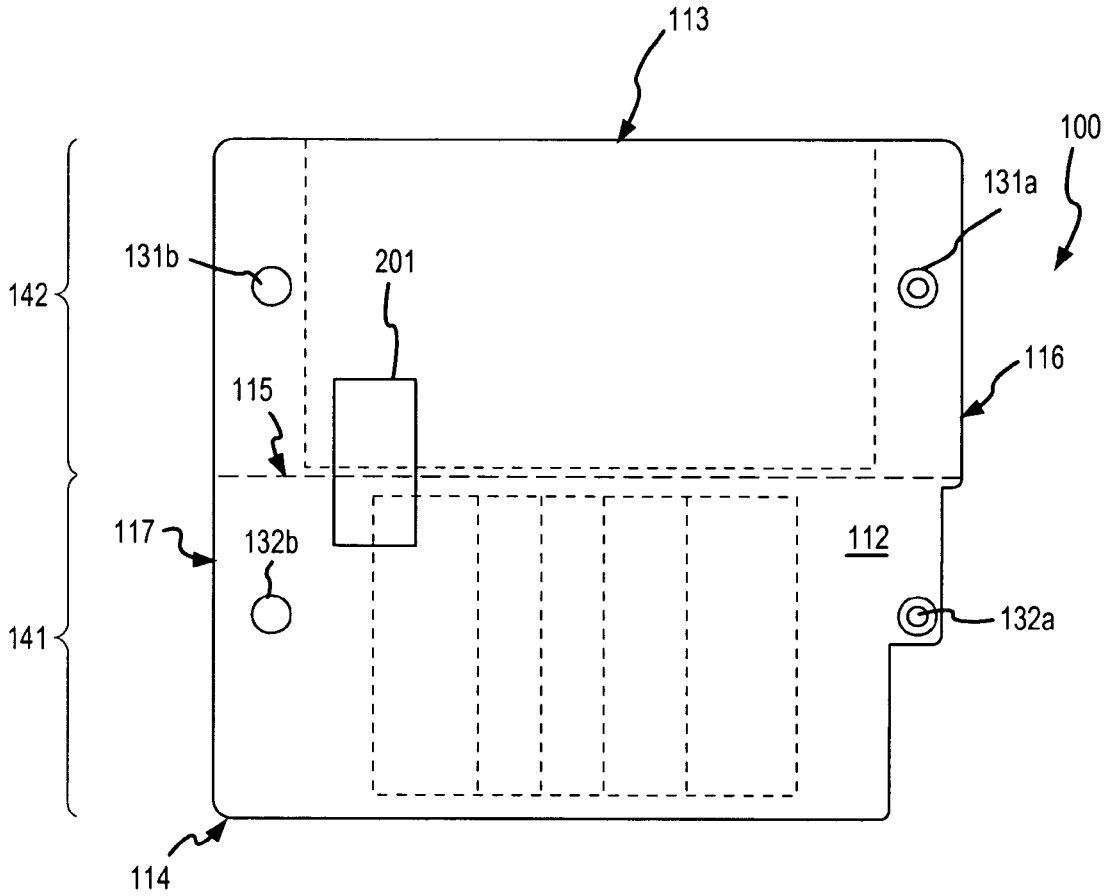
FIG. 2 illustrates a plan view of an outer face of the tool holder of FIG. 1.

Referring now to FIG. 2, illustrated is a plan view of the outer face 112 of the tool holder 100 of FIG. 1. Shown are the covers of the second (e.g., female) portions 131*b*, 132*b* and the first (e.g., male or stud) portions 131*a*, 132*a* of the first and second fasteners, respectively. The flexible wrapper 110 may further include a logotype 201 to identify, for example, a manufacturer of the tool holder 100 or the tools contained therein. The second portions 131*b*, 132*b* and their respective first portions 131*a*, 132*a* are spaced apart along their respective minor edges 116, 117 by substantially the same distances to further facilitate a coupling of the first and second minor edges 116, 117 when overlapped. The fold line 115 divides the first section 141 from the second section 142. The fold line 115 allows the outer surface 112 of the first section 141 to be folded over to contact the outer surface 112 of the second section 142.

Figure 3:
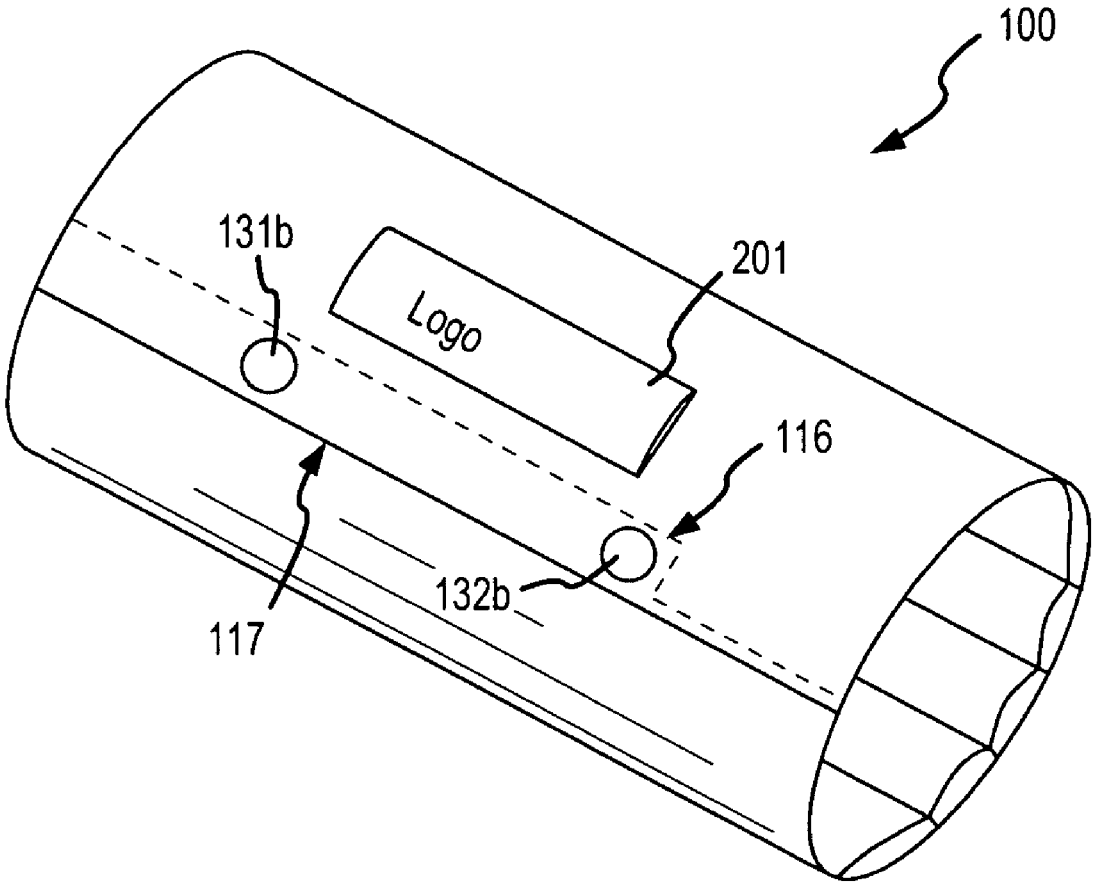
FIG. 3 illustrates an isometric view of the tool holder of FIG. 1 in a rolled, storage configuration.

Referring now to FIG. 3, illustrated is an isometric view of the tool holder 100 of FIG. 1 in a rolled, storage configuration. Shown are the covers of the second portions 131*b*, 132*b* of the first and second fasteners that couple the first and second minor edges 116, 117 together when overlapped. The logotype 201 is visible in this configuration.

Figure 4:
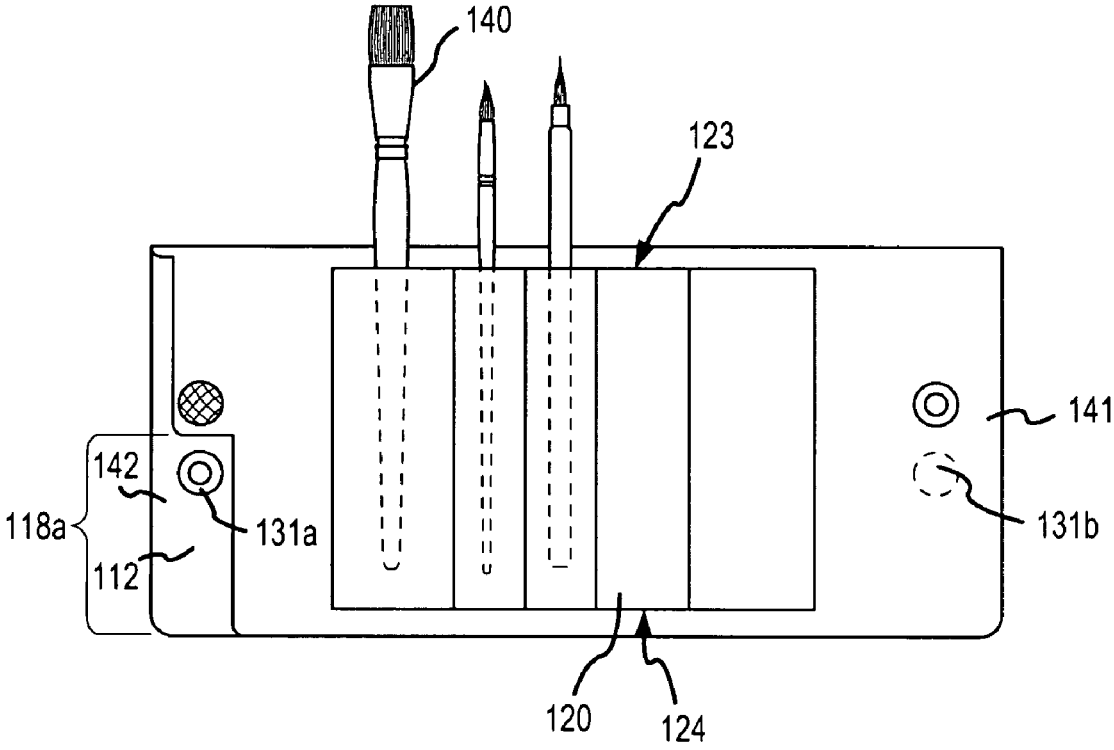
FIG. 4 illustrates a plan view of the tool holder of FIG. 1 with the outer face of a second section thereof folded over and in contact with the outer face of a first section thereof.

Referring now to FIG. 4, illustrated is a plan view of the tool holder 100 of FIG. 1 with the outer face 112 of the second section 142 folded over and in contact with the outer face 112 of the first section 141. The first portion 131*a* of the first fastener is shown to be in alignment with the first notch 118*a*. The pockets 120 with an open end 123 and closed end 124 are clearly visible. The second portion 131*b* of the first fastener is shown in phantom and aligned to couple to the first portion 131*a* when the tool holder 100 is rolled to couple the first and second minor edges 116, 117 together in an overlapped configuration. In the preferred embodiment shown, the tools 140 are shown as they would appear having been inserted into the open end 123 of the pockets 120.

Figure 5:
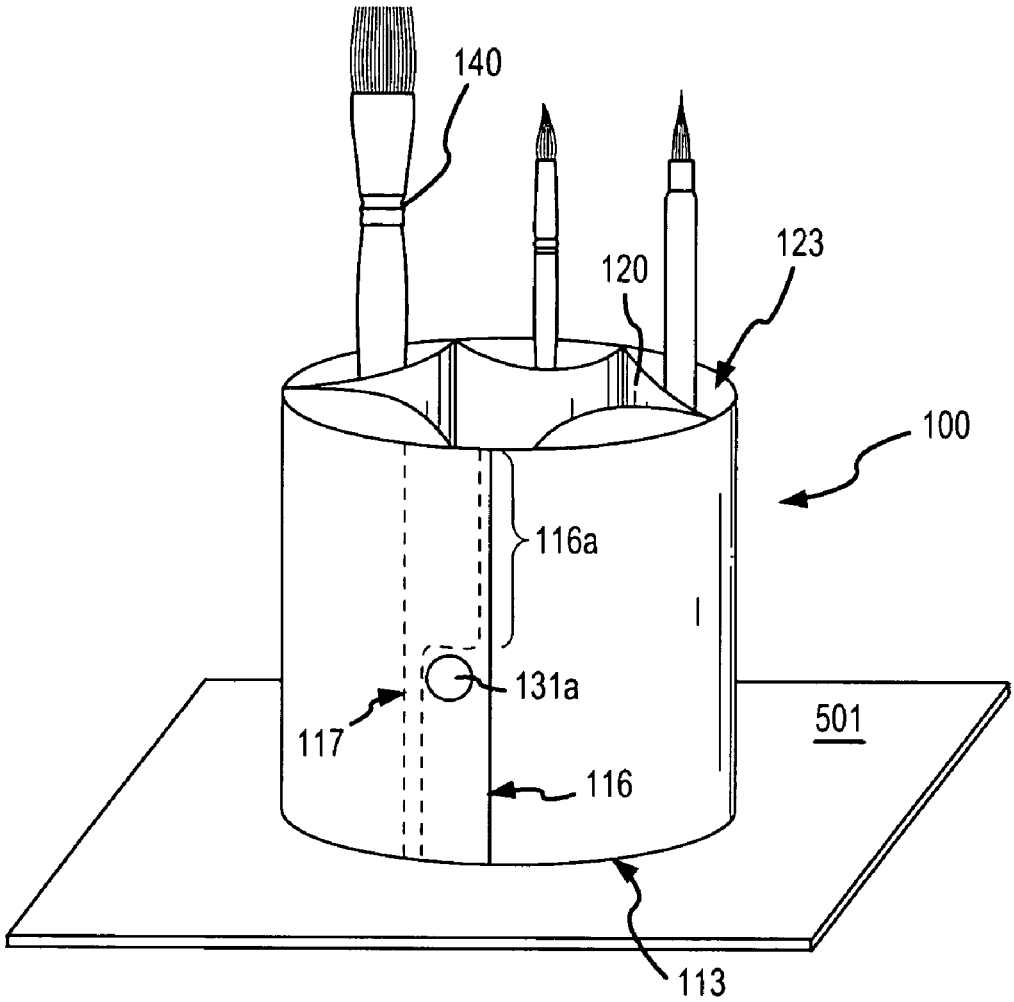
FIG. 5 illustrates an isometric view of the tool holder of FIG. 1 in a free-standing, substantially circular display configuration.

Referring now to FIG. 5, illustrated is an isometric view of the tool holder 100 of FIG. 1 in a free-standing, substantially circular display configuration. The first major edge 113 is shown free standing upon a surface 501. It can be readily seen that the free-standing display of FIG. 5 consumes a significantly smaller amount of space as a free-standing, substantially circular display stand than the unrolled holder displayed in FIG. 1. The back side of the first portion 131*a* of the first fastener is shown as it couples the first and second minor edges 116, 117 together in an overlapped configuration. The indention 116*a* is configured so that the first minor edge 116 in that area does not protrude from under the folded-over first minor edge 116 when the tool holder 100 is in this configuration.

Furthermore, the first notch 118*a* allows the first and second portions 131*a*, 131*b* of the first fastener to align in opposition for coupling. Shown are the tools 140 as they would appear extending from the open end 123 of the pockets 120. Those skilled in the art will readily understand the convenience that the present invention provides by being a free-standing holder of tools, e.g., cosmetic brushes, that extend from and are clearly visible as to size or type when compared to a conventional tool holder that must lie flat upon a work surface.

Figure 6:
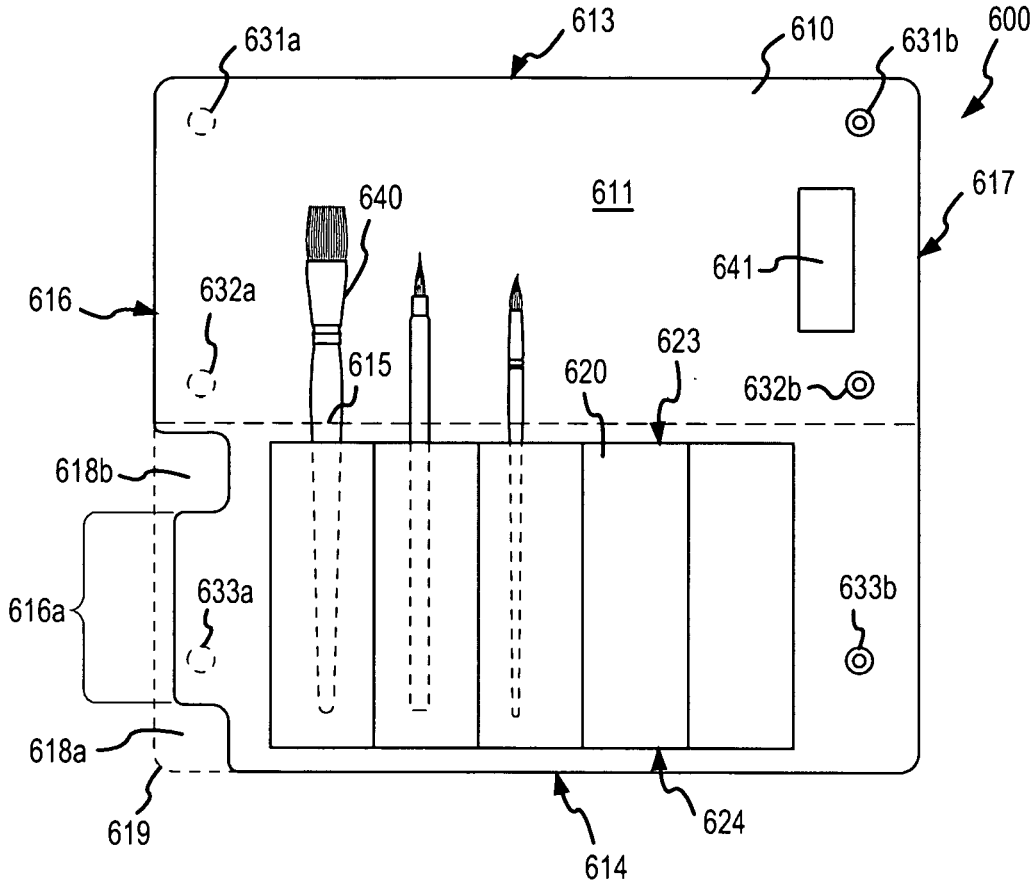
FIG. 6 illustrates a plan view of an alternative embodiment of a tool holder constructed according to the principles of the present invention.

Referring now to FIG. 6, illustrated is a plan view of an alternate embodiment of a tool holder 600 constructed according to the principles of the present invention. The tool holder 600 includes a flexible wrapper 610, a pocket or plurality of pockets (one of which is designated 620), first, second and third fasteners, and a first logotype 641. While three fasteners are illustrated, it should be clear to those skilled in the art that only a single fastener is necessary to comply with the principles of the present invention. The flexible wrapper 610 has an inner face 611 and an outer face (see FIG. 7). The tool holder 600 is shown in FIG. 6 as it would appear laid open upon a horizontal surface. While not shown in order to enhance the clarity of other features in this embodiment, those skilled in the art will realize that a purse analogous to the purse 143 of the tool holder 100 illustrated in FIG. 1 may likewise be employed in this embodiment.

The flexible wrapper 610 is constructed of a sheet-like material, e.g., leather, and is preferably substantially rectangular in shape (although other shapes are well within the broad scope of the present invention). The flexible wrapper 610 has first and second parallel major edges 613, 614 (synonymously referred to as first and second major edges), first and second parallel minor edges 616, 617 (synonymously referred to as first and second minor edges), and a fold line (e.g., centerline) 615 between the first and second major edges 613, 614. While the fold line 615 is illustrated and hereinafter described as a centerline between the first and second major edges 613, 614, those skilled in the art understand that it is not necessary to locate the fold line 615 equidistant between the first and second major edges 613, 614. It should also be understood that for the purposes of this discussion that the terms fold line and centerline may be used interchangeably. The first minor edge 616 has a first notch 618*a* therein proximate a corner 619 thereof and a second notch 618*b* therein proximate the fold line 615.

The first, second and third fasteners include first portions 631*a*, 632*a*, 633*a* and second portions 631*b*, 632*b*, 633*b*, respectively. The first minor edge 616 also has an indention 616*a* formed therein from about the first notch 618*a* to about the second notch 618*b*. The first portions 631*a*, 632*a*, 633*a* of the first, second and third fasteners are spaced apart and coupled to the flexible wrapper 610 proximate the first minor edge 616. The second portions 631*b*, 632*b*, 633*b* of the first, second and third fasteners are spaced apart and coupled to the flexible wrapper 610 proximate the second minor edge 617. In a preferred embodiment, the first portions 631*a*, 632*a*, 633*a* are male (stud) portions of a conventional snap fastener. The back side of the first portions 631*a*, 632*a*, 633*a* are shown in FIG. 6. Similarly, the second portions 631*b*, 632*b*, 633*b* include female (receiving) portions of the snap fasteners.

In an alternative embodiment, the first portions 631*a*, 632*a*, 633*a* may be hook portions of a Velcro® fastener and the second portions 631*b*, 632*b*, 633*b* may be pile portions of the Velcro® fastener. Of course, the hook and pile portions may be interchanged while remaining within the scope of the present invention. Similarly, other types of fasteners, e.g., magnetic, clasps, buttons, etc. may also by used. Those skilled in the art are familiar with the conventional methods used to couple such fasteners to the flexible wrapper 610. When the flexible wrapper 610 is rolled up, the first portions 631*a*, 632*a*, 633*a* and second portions 631*b*, 632*b*, 633*b* are configured to couple the first and second minor edges 616, 617 together, wherein the second minor edge 617 overlaps the first minor edge 616.

The pockets 620 are affixed to the inner face 611 by sewing or with a suitable adhesive. The pockets 620 have an open end 623 aligned proximate the fold line 615 and a closed end 624 aligned proximate the first major edge 614. The open end 623 of the pockets 620 are configured to each receive at least a portion of a tool 640. In a typical embodiment, the pockets 620 number five. However, those skilled in the art will realize that the number of pockets 620 may vary above or below five as required. The tool 640 may be virtually any tool, e.g., a screwdriver, a nutdriver, a wrench, a brush, a pair of pliers, a scraper, a knife, or a scalpel, etc. In a preferred embodiment, the tools 640 are a variety of cosmetic brushes or artist's brushes. Those skilled in the art will recognize that both cosmetologists and artists use a variety of brushes to accomplish their respective arts.

Figure 7:
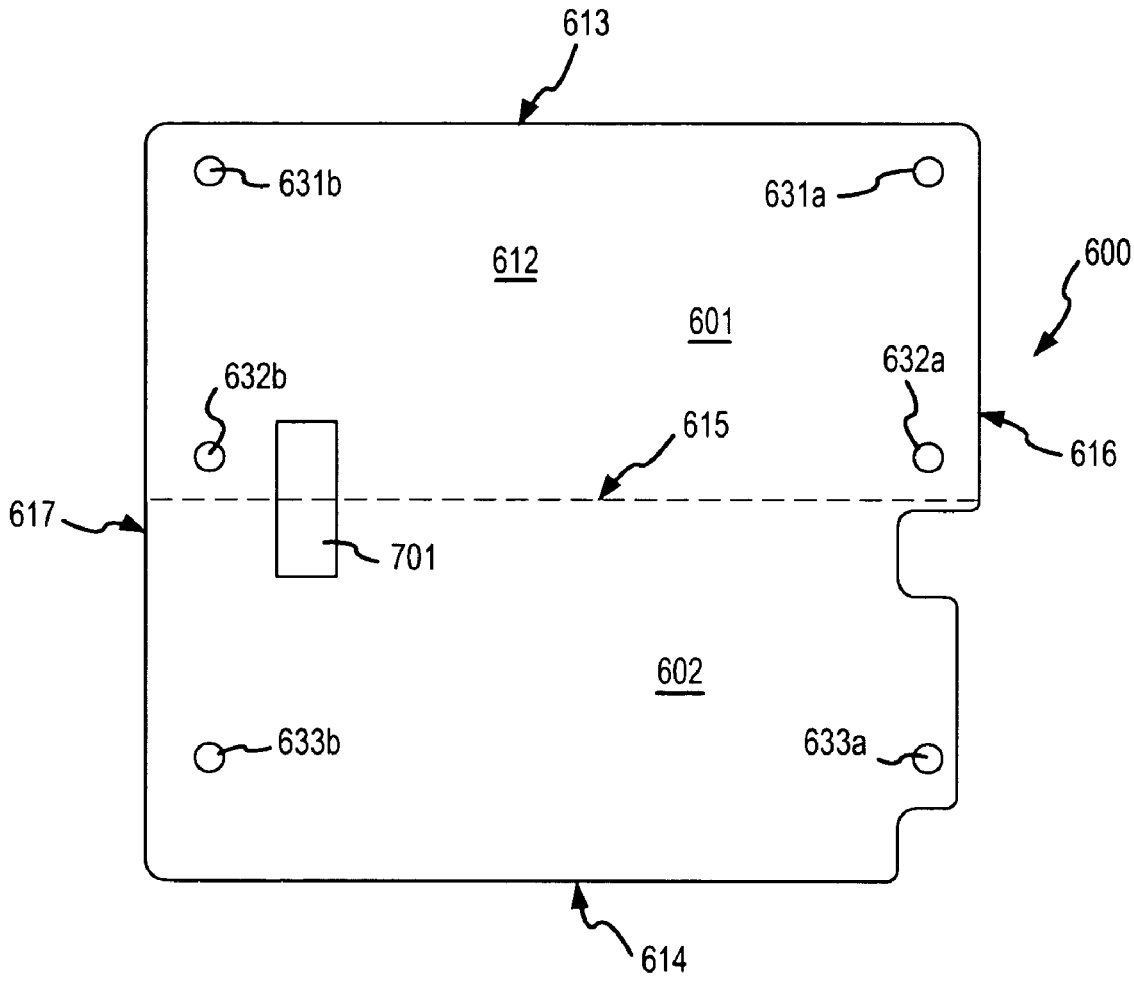
FIG. 7 illustrates a plan view of an outer face of the tool holder of FIG. 6.

Referring now to FIG. 7, illustrated is a plan view of the outer face 612 of the tool holder 600 of FIG. 6. Shown are the covers of the second (e.g., female) portions 631*b*, 632*b*, 633*b* and the first (e.g., male) portions 631*a*, 632*a*, 633*a* of the first, second and third fasteners. The flexible wrapper 610 may further include a second logotype 701 to identify, for example, a manufacturer of the tool holder 600 or the tools 640 contained therein. The second portions 631*b*, 632*b*, 633*b* and their respective first portions 631*a*, 632*a*, 633*a* are spaced apart along their respective minor edges 616, 617 by substantially the same distances to further facilitate a coupling of the first and second minor edges 616, 617 when overlapped. The fold line 615 divides a first section 601 from a second section 602 and allows the first section 601 to be folded over and in contact with the second section 602.

Figure 8:
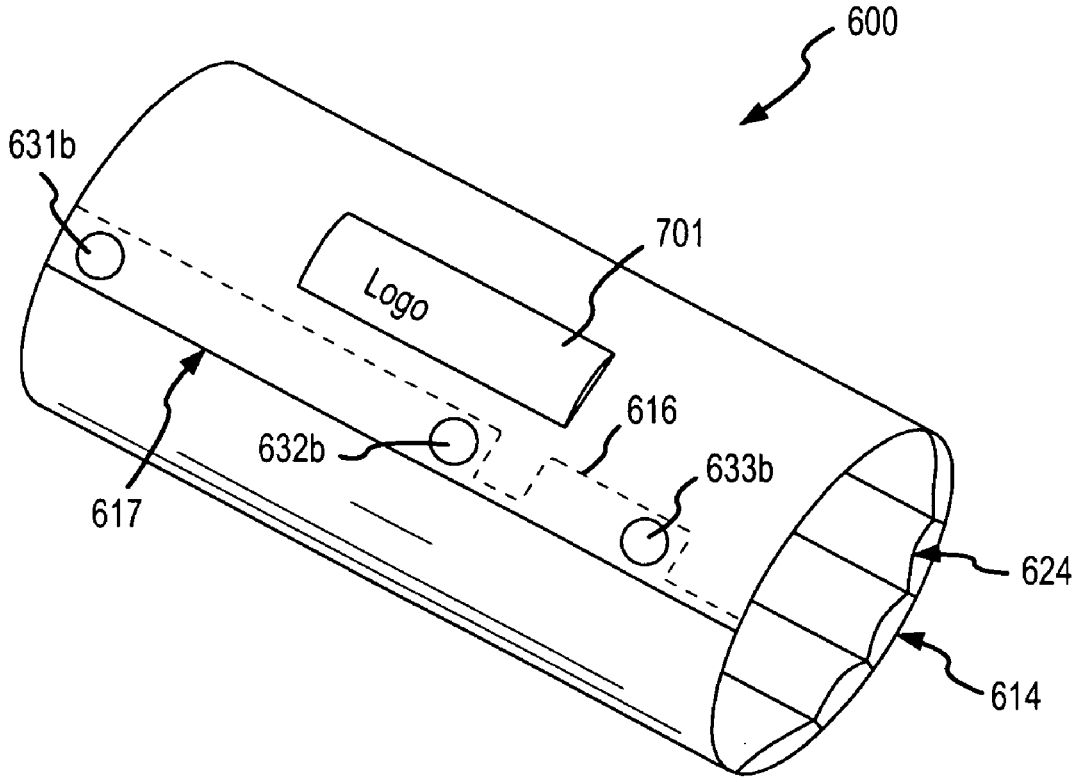
FIG. 8 illustrates an isometric view of the tool holder of FIG. 6 in a rolled, storage configuration.

Referring now to FIG. 8, illustrated is an isometric view of the tool holder 600 of FIG. 6 in a rolled, storage configuration. Shown are the covers of the second portions 631*b*, 632*b*, 633*b* of the first, second and third fasteners that couple the first and second minor edges 616, 617 together when overlapped. The second logotype 701 is visible in this configuration.

Figure 9:
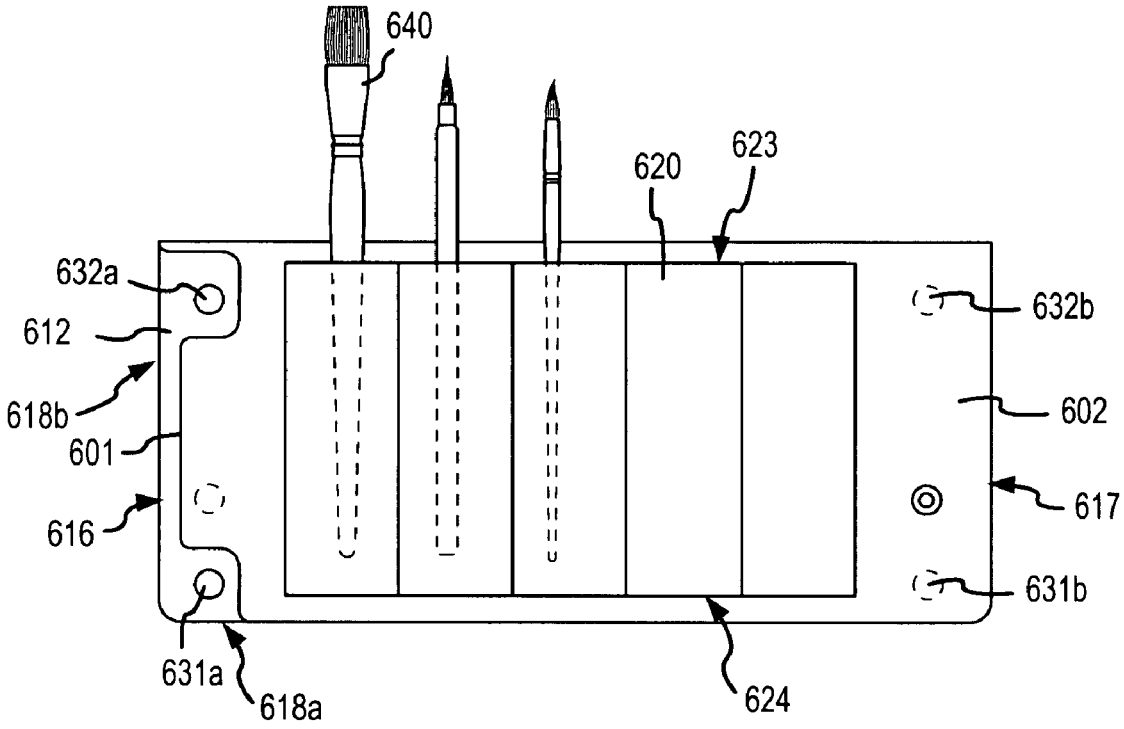
FIG. 9 illustrates a plan view of the tool holder of FIG. 6 with the outer face of a first section thereof folded over and in contact with the outer face of a second section thereof.

Referring now to FIG. 9, illustrated is a plan view of the tool holder 600 of FIG. 6 with the outer face 612 of the first section 601 folded over and in contact with the outer face 612 of the second section 602. The first portions 631*a*, 632*a* of the first and second fasteners are shown to be in alignment with the first notch 618*a* and the second notch 618*b*, respectively. The pockets 620 with the open end 623 and closed end 624 are clearly visible. The second portions 631*b*, 632*b* of the first and second fasteners are shown in phantom and aligned to couple to the first portions 631*a*, 632*a* when the tool holder 600 is rolled to couple the first and second minor edges 616, 617 together in an overlapped configuration. In the preferred embodiment shown, the tools 640 are shown as they would appear having been inserted into the open end 623 of the pockets 620.

Figure 10:
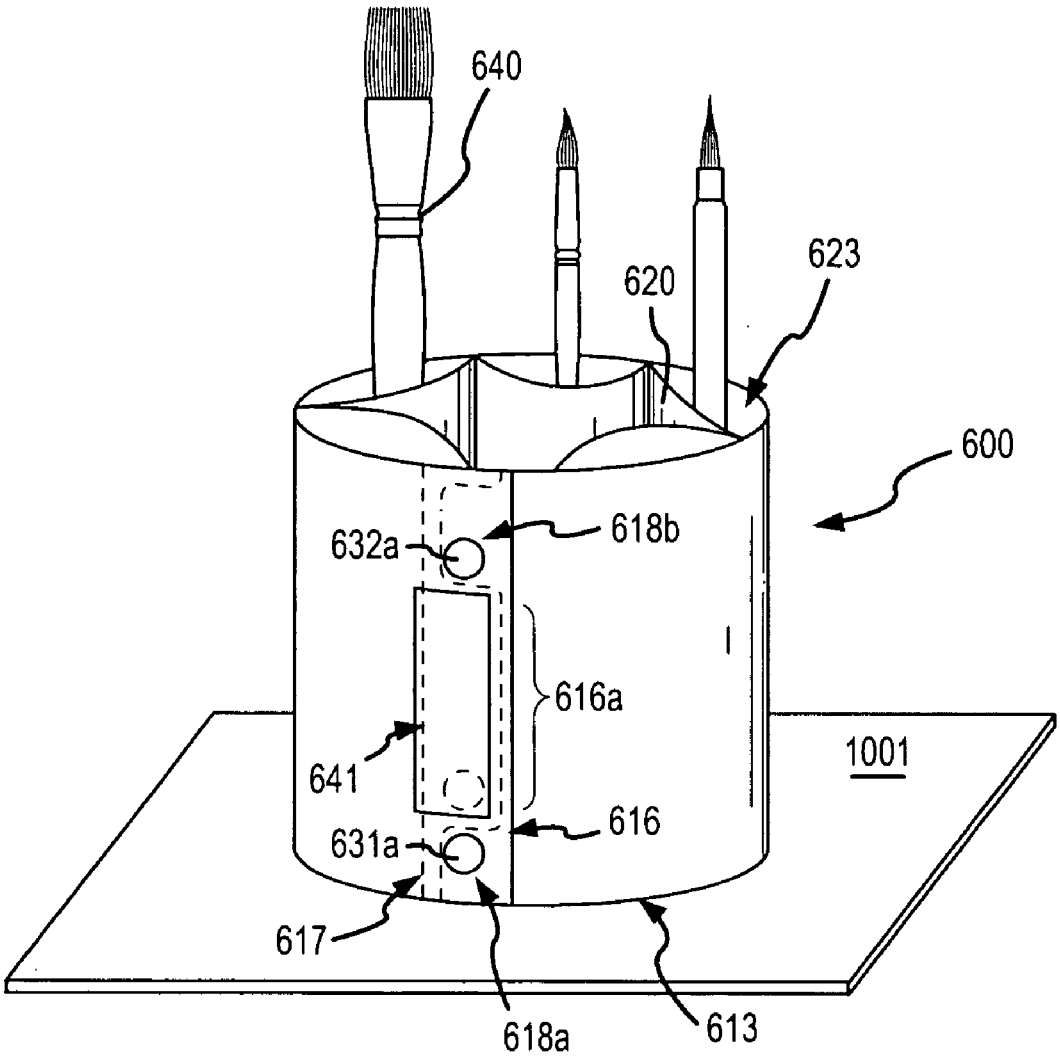
FIG. 10 illustrates an isometric view of the tool holder of FIG. 6 in a free-standing, substantially circular display configuration.

Referring now to FIG. 10, illustrated is an isometric view of the tool holder 600 of FIG. 6 in a free-standing, substantially circular display configuration. The first major edge 613 is shown free standing upon a surface 1001. It can be readily seen that the free-standing display of FIG. 10 consumes a significantly smaller amount of space than the unrolled holder of FIG. 6. The back side of the first portions 631*a*, 632*a* of the first and second fasteners are shown as they couple the first and second minor edges 616, 617 together in an overlapped configuration. The indention 616*a* is configured so that the first minor edge 616 in that area does not protrude from under the folded-over first minor edge 616 when the tool holder 600 is in this configuration.

Furthermore, the first notch 618*a* allows the first and second portions 631*a*, 631*b* of the first fastener to align in opposition while the second notch 618*b* allows the first and second portions 632*a*, 632*b* of the second fastener to align in opposition, so that the first and second portions 631*a*, 631*b* of the first fastener and the first and second portions 632*a*, 632*b* of the second fastener may be coupled. The first logotype 641 is visible in this configuration. Shown are the tools 640 as they would appear extending from the open end 623 of the pockets 620.

Thus, a tool holder has been described that provides a convenient roll-up storage configuration for many tools that protects the tools. The tool holder is convertible to a free-standing configuration that makes the same tools readily available for selection while occupying a significantly smaller footprint than when unrolled as a conventional tool holder would be.

Although the present invention has been described in detail, those skilled in the art should understand that they can make various changes, substitutions and alterations herein without departing from the spirit and scope of the invention in its broadest form.

What is claimed is:

1. A tool holder, comprising:

a flexible wrapper including first and second parallel major and minor edges and a fold line located between said first and second major edges, said first minor edge having a first notch proximate a corner of said first minor edge of said wrapper, wherein said flexible wrapper has an inner face and further comprising at least one pocket affixed to said inner face, said at least one pocket having an open end aligned proximate said fold line and a closed end aligned proximate said first major edge, said at least one pocket configured to receive at least a portion of a tool; and a first fastener including first and second portions located proximate said first and second minor edges, respectively, wherein said fastener portions are situationally disposed on an opposite side of said fold line from said first notch and capable of adjacent orientational arrangement in opposition so as to cause a coupling of said first and second minor edges such that when said wrapper is folded along said fold line said fastener portions disposed on an opposite side of said fold line from said first notch are registered with said first notch, thereby forming a generally cylindrical holder.

2. The tool holder as recited in claim 1 wherein said tool is selected from the group consisting of:

a screwdriver;
a nutdriver;
a wrench;
a brush;
a pliers;
a scraper;
a knife;
a pen;
a pencil; and
a scalpel.

3. The tool holder as recited in claim 1 wherein said at least one pocket is configured to receive at least a portion of a cosmetic tool or an artist's tool.

4. The tool holder as recited in claim 1 wherein said cosmetic tool is selected from the group consisting of:

a brush;
a lipstick;
an eyeliner;
a mascara pencil; and
a spatula.

5. The tool holder as recited in claim 1 wherein said flexible wrapper has inner and outer faces, said flexible wrapper configured to form a substantially circular display stand when:

said flexible wrapper is folded along said fold line such that a first section of said outer face contacts a second section of said outer face; and said first portion of said first fastener is coupled to said second portion of said first fastener.

6. The tool holder as recited in claim 1 wherein said first portion comprises a male portion of a snap fastener and said second portion comprises a female portion of said snap fastener.

7. The tool holder as recited in claim 1 further comprising a second fastener including first and second portions located proximate said first and second minor edges, respectively, and alignable in opposition to further allow a coupling of said first second minor edges.

8. The tool holder as recited in claim 7 further comprising:

a second notch in said first minor edge located proximate said fold line; and a third fastener having first and second portions located proximate said first and second minor edges, respectively, and alignable in opposition to further allow a coupling of said first and second minor edges.

9. The tool as recited in claim 1 further comprising a second fastener including first and second portions located proximate said first and second minor edges, respectively, and alignable in opposition to further allow a coupling of said first and second minor edges.

10. The tool holder as recited in claim 9 further comprising:

a second notch in said first minor edge located proximate said fold line; and a third fastener having first and second portions located proximate said first and second minor edges, respectively, and alignable in opposition to further allow a coupling of said first and second minor edges.

11. A tool holder, comprising:

a flexible wrapper including first and second parallel major and minor edges and a fold line located between said first and second major edges, said first minor edge having a first notch proximate a corner thereof;

a first fastener including first and second portions located proximate said first and second minor edges, respectively, and alignable in opposition to allow a coupling of said first and second minor edges;

wherein said flexible wrapper has an inner face and further comprising at least one pocket affixed to said inner face, said at least one pocket having an open end aligned proximate said fold line and a closed end aligned proximate said second major edge, said at least one pocket configured to receive at least a portion of a tool; and, wherein said fold line is a centerline dividing said flexible wrapper into first and second sections, said at least one pocket affixed to said first section, said tool holder further comprising a purse affixed to said inner face of said second section and having a closure along at least a portion of said first major edge.

12. A tool holder, comprising:

a flexible wrapper including first and second parallel major and minor edges and a fold line located between said first and second major edges, said first minor edge having a first notch proximate a corner thereof;

a first fastener including first and second portions located proximate said first and second minor edges, respectively, and alignable in opposition to allow a coupling of said first and second minor edges; and, an indention formed in said first minor edge from about said first notch to about said fold line.

13. A tool holder, comprising:

a flexible wrapper including first and second parallel major and minor edges and a fold line located between said first and second major edges, said first minor edge having a first notch proximate a corner thereof;

a first fastener including first and second portions located proximate said first and second minor edges, respectively, and alignable in opposition to allow a coupling of said first and second minor edges;

a second fastener including first and second portions located proximate said first and second minor edges, respectively, and alignable in opposition to further allow a coupling of said first and second minor edges;

a second notch in said first minor edge located proximate said fold line;

a third fastener having first and second portions located proximate said first and second minor edges, respectively, and alignable in opposition to further allow a coupling of said first and second minor edges; and, an indention formed in said first minor edge from about said first notch to about said second notch.

14. A method of manufacturing a tool holder, comprising:

providing a flexible wrapper including first and second parallel major and minor edges;

forming a fold line between said first and second major edges;

forming a first notch proximate a corner of said first minor edge of said wrapper;

locating a first portion of a first fastener proximate said first minor edge;

locating a second portion of said first fastener proximate said minor edge;

wherein said fastener portions are situationally disposed on an opposite side of said fold line from said first notch;

wherein said flexible wrapper has an inner face and an outer face and further comprising affixing at least one pocket to said inner face, said at least one pocket having an open end aligned proximate said fold line and a closed end aligned proximate said second major edge, said at least one pocket configured to receive at least a portion of a tool;

wherein said flexible wrapper is configured to form a generally cylindrical tool holder when the flexible wrapper is folded along said fold line such that a first section of said outer face contacts a second section of said outer face; and, said first portion of said first fastener is coupled to said second portion of said first fastener to allow a coupling of said first and second minor edges, thereby registering the fastener portions with the notch when the wrapper is folded along the fold line.

15. The method as recited in claim 14 wherein said tool is selected from the group consisting of:

a screwdriver;

a nutdriver;

a wrench;

a brush;

a pliers;

a scraper;

a knife;

a pen;

a pencil; and a scalpel.

16. The method as recited in claim 14 wherein said at least one pocket is configured to receive at least a portion of a cosmetic tool or an artist's tool.

17. The method as recited in claim 14 wherein said cosmetic tool is selected from the group consisting of:

a brush;

a lipstick;

an eyeliner;

a mascara pencil; and a spatula.

18. The method as recited in claim 14 wherein said flexible wrapper has inner and outer faces, said flexible wrapper configured to form a substantially circular display stand when:

said flexible wrapper is folded along said fold line such that a first section of said outer face contacts a second section of said outer face; and said first portion of said first fastener is coupled to said second portion of said first fastener.

19. The method as recited in claim 14 wherein said first portion comprises a male portion of a snap fastener and said second portion comprises a female portion of said snap fastener.

20. The method as recited in claim 14 further comprising:

locating a first portion of a second fastener proximate said first minor edge; and locating a second portion of said second fastener proximate said second minor edge.

21. The method as recited in claim 20 further comprising:

forming a second notch in said first minor edge proximate said fold line;

locating a first portion of a third fastener proximate said first minor edge; and locating a second portion of said third fastener proximate said second minor edge.

22. A method of manufacturing a tool holder, comprising:

providing a flexible wrapper including first and second parallel major and minor edges;

forming a fold line between said first and second major edges;

forming a first notch proximate a corner of said first minor edge;

locating a first portion of a first fastener proximate said first minor edge;

locating a second portion of said first fastener proximate said second minor edge;

wherein said flexible wrapper has an inner face and further comprising affixing at least one pocket to said inner face, said at least one pocket having an open end aligned proximate said fold line and a closed end aligned proximate said second major edge, said at least one pocket configured to receive at least a portion of a tool; and, wherein said fold line is a centerline dividing said flexible wrapper into first and second sections, said at least one pocket affixed to said first section, said method further comprising affixing a purse to said inner face of said second section and having a closure along at least a portion of said first major edge.

23. A method of manufacturing a tool holder, comprising:

providing a flexible wrapper including first and second parallel major and minor edges;

forming a fold line between said first and second major edges;

forming a first notch proximate a corner of said first minor edge;

locating a first portion of a first fastener proximate said first minor edge;

locating a second portion of said first fastener proximate said second minor edge; and, forming an indention in said first minor edge from about said first notch to about said fold line.

24. A method of manufacturing a tool holder, comprising:

providing a flexible wrapper including first and second parallel major and minor edges;

forming a fold line between said first and second major edges;

forming a first notch proximate a corner of said first minor edge;

locating a first portion of a first fastener proximate said first minor edge;

locating a second portion of said first fastener proximate said second minor edge;

locating a first portion of a second fastener proximate said first minor edge;

locating a second portion of said second fastener proximate said second minor edge;

forming a second notch in said first minor edge proximate said fold line;

locating a first portion of a third fastener proximate said first minor edge;

locating a second portion of said third fastener proximate said second minor edge; and, forming an indention in said first minor edge from about said first notch to about said second notch.

25. A method for displaying a tool using a wrapper having a first edge, a second edge, a third edge, and a fourth edge; a fold line interposed between the first edge and the second edge extending from the third edge to the fourth edge and defining a first section having a front and a back and a second section having a front and a back; and at least one pocket located on the front side of the first section, the method comprising the steps of:

opening the wrapper from a closed format wherein the front of the first section is proximate to the front of the second section;

folding the wrapper along the fold line wherein the back of the second section is proximate to the back of the first section and engaging the third edge with the fourth edge to create a display format allowing access to the pocket.

26. The method of claim 25 wherein the third edge and fourth edge are engaged with a fastener.

27. The method of claim 26 wherein the fastener is a snap.

28. The method of claim 25 wherein the wrapper is leather.

29. The method of claim 25 wherein the wrapper is plastic.

30. The method of claim 25 wherein the pocket is configured to receive a tool.

31. The method of claim 30 wherein the tool is a cosmetic tool.

32. The method of claim 25 further comprising the step of standing the wrapper on the third edge while the wrapper is in display format.

* * * * *

US006926151C1

(12) EX PARTE REEXAMINATION CERTIFICATE (6973rd)

United States Patent
Perry et al.

(10) Number: US 6,926,151 C1
(45) Certificate Issued: Aug. 4, 2009

(54) TOOL HOLDER AND METHOD OF USE

(76) Inventors: Martha Starr Perry, 10 Ski Haven, Justin, TX (US) 76247; Michael Stuart Perry, 10 Ski Haven, Justin, TX (US) 76247

Reexamination Request:
No. 90/010,061, Dec. 3, 2007

Reexamination Certificate for:

| | |
|---|---|
| Patent No.: | **6,926,151** |
| Issued: | **Aug. 9, 2005** |
| Appl. No.: | **10/274,334** |
| Filed: | **Oct. 18, 2002** |

Related U.S. Application Data

(60) Provisional application No. 60/394,617, filed on Jul. 9, 2002.

(51) Int. Cl.
*B65D 85/20* (2006.01)

(52) U.S. Cl. ..... 206/750; 206/214; 206/349; 206/361; 206/362; 206/363; 206/370; 206/371; 206/372; 206/373; 206/376; 206/752; 383/39; 493/210

(58) Field of Classification Search ..... None
See application file for complete search history.

(56) References Cited

U.S. PATENT DOCUMENTS

| | | | | |
|---|---|---|---|---|
| 2,219,597 A | * | 10/1940 | Lutz | 206/755 |
| 2,801,739 A | | 8/1957 | Christensen | |
| 3,769,741 A | | 11/1973 | Hessler et al. | |
| 5,174,447 A | | 12/1992 | Fleming | |
| 5,653,337 A | | 8/1997 | Cirigliano | |
| 5,769,213 A | * | 6/1998 | Chatterton | 206/38 |

* cited by examiner

*Primary Examiner*—Glenn K. Dawson

(57) ABSTRACT

The present invention is directed to a tool holder convertible between storage and display configurations and a method of manufacture therefor. In one embodiment, the tool holder includes a flexible wrapper including first and second parallel major and minor edges and a fold line located between the first and second major edges. The first minor edge includes a first notch proximate a corner thereof. The tool holder also includes a first fastener including first and second portions located proximate the first and second minor edges, respectively, that is alignable in opposition to allow a coupling of the first and second minor edges.

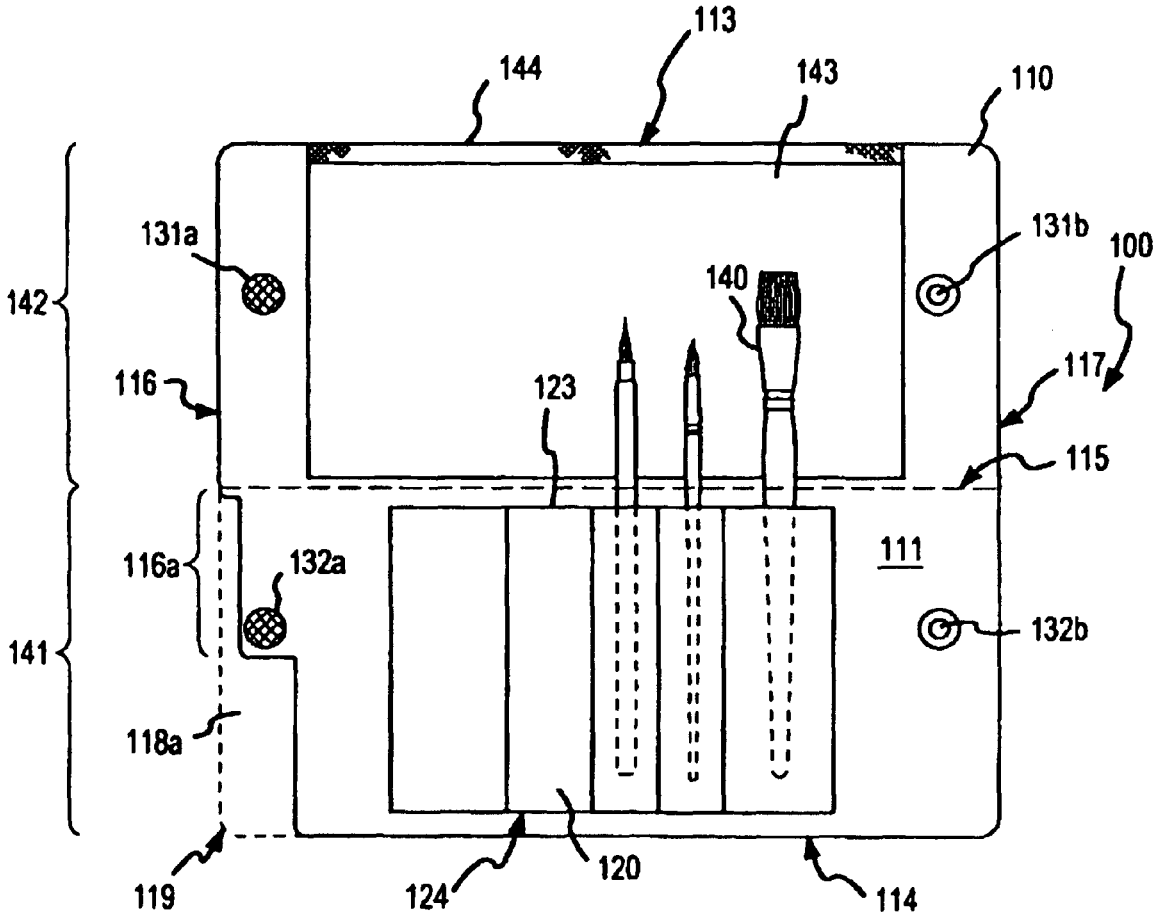

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claim 32 is confirmed.
Claims 25–31 are cancelled.
Claims 1–24 were not reexamined.

* * * * *